US006209262B1

(12) United States Patent
Mathis

(10) Patent No.: US 6,209,262 B1
(45) Date of Patent: Apr. 3, 2001

(54) OBSTRUCTION SENSING SYSTEM FOR A GATE

(76) Inventor: Calvin F. Mathis, 17509 Graystone Ave., Cerritos, CA (US) 90703

( * ) Notice: Subject to any disclaimer, the term of this patent is extended or adjusted under 35 U.S.C. 154(b) by 0 days.

(21) Appl. No.: 09/492,370

(22) Filed: Jan. 27, 2000

(51) Int. Cl.[7] ..... E05F 15/02
(52) U.S. Cl. ..... 49/28
(58) Field of Search ..... 49/26, 27, 28; 200/61.43

(56) References Cited

U.S. PATENT DOCUMENTS 1,752,476 * 4/1930 Boedtcher ..... 49/27
3,050,155 * 8/1962 Karmel et al ..... 49/27
3,168,165 * 2/1965 Bagnasco ..... 49/27 X
4,301,621 * 11/1981 Houweling ..... 49/27
4,944,116 * 7/1990 Mewald ..... 49/27

* cited by examiner

*Primary Examiner*—Jerry Redman
(74) *Attorney, Agent, or Firm*—Howard A. Kenyon

(57) ABSTRACT

A sensing system for a gate to protect persons and equipment from impact damage by actuating a gate operating system when the end of the gate comes in contact with an obstruction. The force required to actuate the device varies between 3 and 5 pounds. Once the force is applied to the edge of the gate, the gate opening or closing operation will either stop or reverse depending on the specific safety requirements of the gate installation. The force can be applied to any available direction and the system will be activated.

16 Claims, 1 Drawing Sheet

OBSTRUCTION SENSING SYSTEM FOR A GATE

BACKGROUND OF THE INVENTION

1. Field of the Invention

This invention relates in general to a sensing system for a gate and more specifically to a sensing system that is applied to the vertical leading edge of a gate.

2. Description of the Prior Art

There are many devices on the market that sense an object being in the path of a closing gate or closing garage door that will take corrective action. The requirement for the above stems from the a 1995 Federal mandate that governs the parameters of safety devices installed on residential garage doors which must be fail-safe, therefore, the automatic garage door must reverse itself without producing a force that would injure. Recently, the same requirement has been imposed on automatic gates. Some of the patents on sensing edges are:

1. U.S. Pat. No. 5,066,835 to Miller et al. This patent has a sensing edge with a switch assembly positioned thereon.

2. U.S. Pat. No. 5,027,552 to Miller et al. This patent includes a proximity sensing switch that detects a change in capacitance to actuate the device that controls a door.

3. U.S. Pat. No. 5,299,387 to Miller et al describes a sensing edge for a gate. Two layers of conducting material are spaced apart such that a force on the gate edge will cause the conducting material to contact and close a circuit.

4. U.S. Pat. No. 5,964,058 to Richardson describes an electrosensing edge for a garage door. A cable on the bottom edge is moved when the bottom edge strikes an object and thereby actuates switches attached to the ends of the cable.

U.S. Pat. No. 5,079,417 to Strand describes a photocell beam shining through the door edge and if an object blocks the beam, the photo switch provides a signal to reverse the motion.

What is needed, is an inexpensive device that uses mechanical means to activate a switch whereby the force can be multiple directional.

From the foregoing, the need should be appreciated for an inexpensive and simple gate sensing system. Accordingly, a fuller understanding of the invention may be obtained by referring to the Summary of the Invention, and the Detailed Description of the Preferred Embodiment, in addition to the scope of the invention defined by the claims taken in conjunction with the accompanying drawings.

SUMMARY OF THE INVENTION

It is the object of the present invention to provide a novel sensing edge for an automatic gate.

It is another object of the present invention to provide a sensing edge that can be activated in multiple directions.

It is yet another object of the present invention where the activation of the sensing edge will provide a signal to be transmitted to the gate mechanism.

It is still another object of the present invention where the activation of the sensing edge will directly provide an input signal to the gate mechanism.

Briefly, in accordance with the present invention there is providing a sensing edge that is mounted on the vertical edge of a powered gate. If the gate edge encounters an object in its path, a pressure of three to five pounds on the gate edge will activate the gate mechanism. The edge is designed such that any object in the gate path on the front, right or left side will activate the gate mechanism.

The novel features which are believed to be characteristics of the invention, both as its organization and its method of operation, together with further objects and advantages thereof, will be better understood from the following description in connection with the accompanying drawings in which a presently preferred embodiment of the invention is illustrated by way of example. It is to be expressly understood, however, that the drawings are for purposes of illustration and description only, and are not intended as a definition of the limits of the invention.

DESCRIPTION OF THE DRAWINGS

In the drawings which illustrate the best mode presently contemplated for carrying out the present invention.

These and other objects, features and advantages of the present invention will become more readily apparent upon detailed consideration of the following Description of the Preferred Embodiment with reference to the accompanying drawings.

DESCRIPTION OF THE PREFERRED EMBODIMENT

Figure 1:
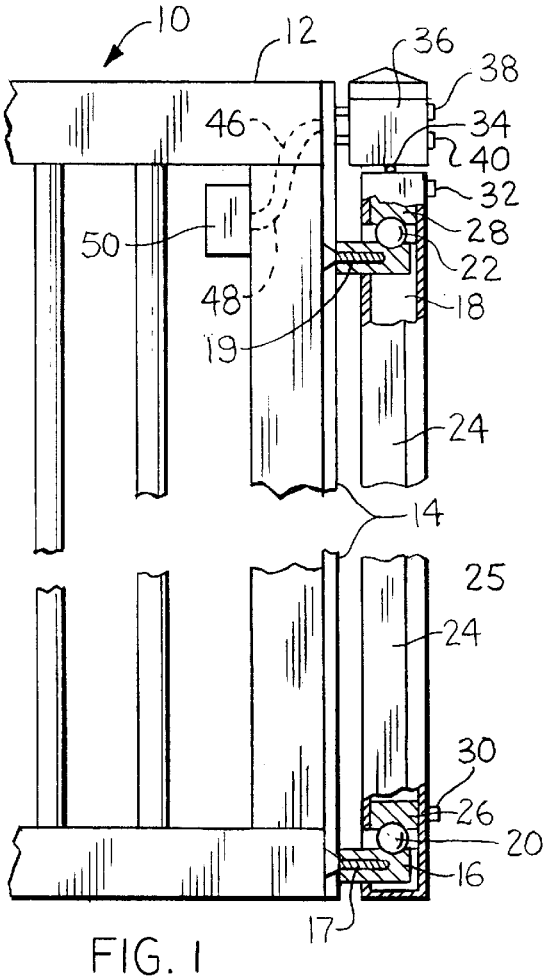
FIG. 1 shows a partial view of a gate with the sensing system attached to the leading edge of the gate.

Turning now to FIG. 1 there is seen a gate generally described as 10. The gate has an opening and closing mechanism (not shown) that is powered. Attached to the leading edge 12 of the gate 10 is a plate 14 fastened by any acceptable fastening means. Fastened to the plate 14 are lower ball retaining members 16 and 18 held by fastening means 17 and 19. On the top of the lower ball retaining members 16 and 18 are round balls 20 and 22. The balls 20 and 22 may be made from any hard material such as metal or plastic. A rectangular tube 24 is used to conform to the shape of the leading edge of the gate. Fastened inside of the tube 24 are upper ball retaining member 26 and 28. The fastening members are shown as 30 and 32. The tube 24 is held in place on balls 20 and 22 by gravity. On the top of tube 24 is fastened a plate 34 which is more clearly seen in FIG. 2.

Figure 2:
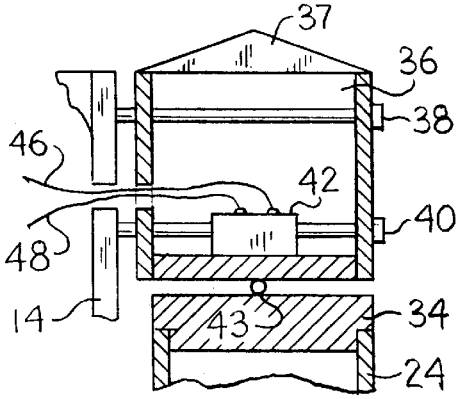
FIG. 2 shows a switch box including the switch mechanism required to control the movement of the gate.

FIG. 2 shows the plate 34 which is fastened to the top of tube 24. Also seen in FIG. 2 is a switch box 36 that is fastened to plate 14 by fastening means 38 and 40. As seen in the cut away of FIG. 2, the switch box contains a snap action switch 42 that operates when plate 34 moves in an upward direction. Roller 43 moves on top of plate 34 when plate 34 moves in an upward direction. FIG. 2 also shows a waterproof cover 37 fixed on the top of switch box 36.

Figure 3:
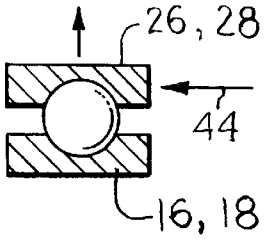
FIG. 3 shows the principle behind the gate sensing system.

FIG. 3 shows the principle utilized in the sensing system in the present invention. As the force 44 is applied to an upper ball retaining member, either 26 or 28, since the lower ball retaining members are fastened to the gate through plate 14 and the upper ball retaining members 26 and 28 are fastened to the tube 24, the upper ball retaining members 26 and 28 will ride up the balls 20 and 22 and move the upper ball retaining members 26 and 28 in an upward movement. Since the upper ball retaining members 26 and 28 are fastened to tube 24, the plate 34 fastened to the top of tube 24 will move upward and activate switch 42. The action of switch 42 will complete a circuit and send a signal through wires 46 and 48 to transmitter 50 as seen in FIG. 1. The transmitter 50, in turn, will send a signal to the gate control mechanism (not shown) and the signal will either stop the gate control mechanism or reverse the gate control mechanism depending on how the gate control mechanism is configured which in turn depends on the safety requirement of the gate installation.

Figure 4:
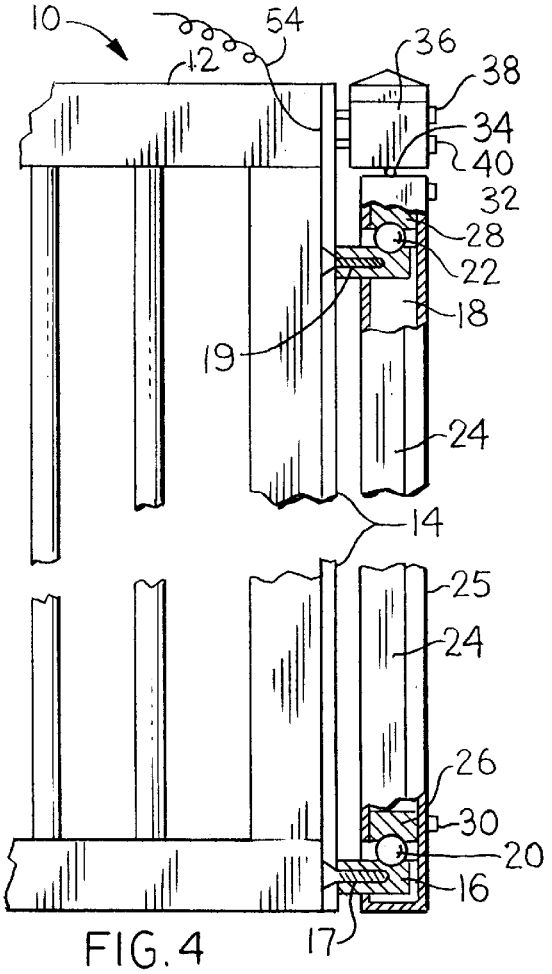
FIG. 4 shows an alternate way to send a signal to the gate control mechanism.

FIG. 4 shows an alternate method to send a signal to the gate control mechanism. The hard wire 54 directly sends a signal to activate the gate control mechanism. The hardwire can either be a curly wire or be in a spring retraction reel (not shown). As an option the leading edge of the tube 24 may have a rubber channel 25 fixed thereon.

Thus, it is apparent that there has been provided in accordance with the invention, a sensing edge for a gate that fully satisfies the objectives, aims, and advantages set forth above. While the invention has been described in conjunction with specific embodiment thereof it is evident that many alternatives, modifications, and variations will be apparent to those skilled in the art in light of the aforegoing descriptions. Accordingly, it is intended to embrace all such alternatives, modifications, and variations that fall within the spirit and scope of the appended claims.

What is claimed:

1. A powered gate having a mechanism to open and close said gate comprising:

a plate fastened to the leading edge of said gate;

at least two lower ball retaining members fastened to said gate;

a tube, said tube having at least two upper ball retaining members fastened thereon, said tube having a front and two sides;

a ball placed between said upper ball retaining members and said lower ball retaining members;

said tube being held in place by gravity, said tube resting on said balls;

a switch box fastened to the upper end of said plate which is fastened to the leading edge of said gate, said switch box containing a switch;

a plate attached to the upper end of said tube.

2. A powered gate as described in claim 1 wherein said tube receiving a force, said tube will move vertically as said upper ball retaining members attempt to move over said balls.

3. A powered gate as described in claim 1 wherein said plate will provide contact means when said plate moves in an upward direction.

4. A powered gate as described in claim 3 wherein said plate moves vertically, said plate provides said contact means which, in turn, activates said switch and provides a closed circuit.

5. A powered gate as described in claim 4 wherein said closed circuit in said switch box provides a signal from said transmitter, said signal activating said mechanism.

6. A powered gate as described in claim 4 wherein a force is applied to said tube, said upper ball retaining members moving over said balls will cause said switch to close and said transmitter will send said signal to activate said mechanism.

7. A powered gate as described in claim 4 wherein a force is applied to said tube, said upper ball retaining members moving over said balls will cause said switch to close and said hard wire sends said signal to activate said mechanism.

8. A powered gate as described in claim 4 wherein a force on said tube may be applied multidirectional.

9. A powered gate as described in claim 8 when said gate mechanism will stop when a force is applied.

10. A powered as described in claim 8 wherein said gate mechanism will reverse when a force is applied.

11. A powered gate as described in claim 1 wherein said gate has a powered transmitter attached thereto.

12. A powered gate as described in claim 11 wherein said transmitter is electrically connected to said switch.

13. A powered gate as described in claim 1 wherein said signal from said switch box to activate said mechanism is provided by hard wire.

14. A powered gate as described in claim 13 wherein said hard wire is a curly wire.

15. A powered gate as described in claim 13 wherein said hard wire is a spring biased reel.

16. A powered gate as described in claim 1 wherein a force applied to said tube of three to five pounds will activate said gate mechanism.

* * * * *